US011384563B2

(12) United States Patent
Zhang et al.

(10) Patent No.: US 11,384,563 B2
(45) Date of Patent: Jul. 12, 2022

(54) SPRING RETAINING ASSEMBLY FOR VEHICLE LATCH ACTUATOR MECHANISM

(71) Applicant: Inteva Products, LLC, Troy, MI (US)

(72) Inventors: Hongqiang Zhang, Jiangsu (CN); Michel Noel, Anould (FR)

(73) Assignee: INTEVA PRODUCTS, LLC, Troy, MI (US)

( * ) Notice: Subject to any disclaimer, the term of this patent is extended or adjusted under 35 U.S.C. 154(b) by 1163 days.

(21) Appl. No.: 15/888,787

(22) Filed: Feb. 5, 2018

(65) Prior Publication Data

US 2018/0252001 A1 Sep. 6, 2018

(30) Foreign Application Priority Data

Mar. 3, 2017 (CN) ..... 201720206424.2

(51) Int. Cl.

| | |
|---|---|
| ***E05B 15/04*** | (2006.01) |
| ***E05B 81/16*** | (2014.01) |
| ***E05B 79/08*** | (2014.01) |
| ***E05B 81/34*** | (2014.01) |

(Continued)

(52) U.S. Cl.

CPC ..... *E05B 15/04* (2013.01); *E05B 79/08* (2013.01); *E05B 81/06* (2013.01); *E05B 81/14* (2013.01); *E05B 81/16* (2013.01); *E05B 81/34* (2013.01); *E05B 2015/0437* (2013.01); *E05B 2015/0455* (2013.01); *Y10S 292/23* (2013.01); *Y10T 292/1047* (2015.04); *Y10T 292/1079* (2015.04); *Y10T 292/1082* (2015.04); *Y10T 292/1092* (2015.04)

(58) Field of Classification Search

CPC ..... Y10T 292/1082; Y10T 292/1092; Y10T 292/1047; Y10T 292/1079; Y10S 292/23; F16F 1/12; F16F 1/16; E05B 15/04; E05B 79/08; E05B 81/16; E05B 81/34; E05B 2015/0437; E05B 2015/0455; E05B 81/06; E05B 81/14

USPC ..... 267/154

See application file for complete search history.

(56) References Cited

U.S. PATENT DOCUMENTS 4,290,634 A * 9/1981 Gelhard ..... E05B 81/25 292/201

5,020,838 A * 6/1991 Fukumoto ..... E05B 81/14 292/201

(Continued)

OTHER PUBLICATIONS

French Preliminary Search Report for Application No. 1851112.
Written Opinion for Application No. 1851112.

*Primary Examiner* — Christine M Mills
*Assistant Examiner* — Faria F Ahmad
(74) *Attorney, Agent, or Firm* — Cantor Colburn LLP

(57) ABSTRACT

An actuator mechanism of a vehicle latch assembly includes an electric motor having an output shaft. Also included is a worm coupled to the output shaft. Further included is a worm gear driven by the worm. Yet further included is a spring operatively coupled to the worm gear and to a latch housing, the spring having a first leg extending through an aperture defined by the worm gear and a second leg extending into a receiving hole defined by the housing, the first leg including a first segment extending along a first leg axis and a second segment oriented at a non-parallel angle to the first leg axis, the second segment contacting a face of the worm gear to prevent removal of the spring.

20 Claims, 5 Drawing Sheets

(51) Int. Cl.
*E05B 81/06* (2014.01)
*E05B 81/14* (2014.01)

(56) References Cited

U.S. PATENT DOCUMENTS 5,855,130 A * 1/1999 Rorabacher ..... E05B 81/25 70/277
6,382,687 B1 * 5/2002 Gruhn ..... E05B 81/14 292/201
6,390,517 B1 * 5/2002 Ehret ..... E05B 81/14 292/201
6,419,286 B1 * 7/2002 Szablewski ..... E05B 77/24 292/216
7,827,836 B2 * 11/2010 Cetnar ..... E05B 77/28 70/257
8,522,583 B2 * 9/2013 Cumbo ..... E05B 81/36 70/279.1
10,641,018 B2 * 5/2020 Dow ..... E05B 81/34
10,920,463 B2 * 2/2021 Estrada ..... E05B 81/14
2001/0024041 A1 * 9/2001 Barczynski ..... E05B 77/26 292/216
2003/0038484 A1 * 2/2003 Schwaiger ..... E05B 81/14 292/201
2004/0055407 A1 * 3/2004 Coleman ..... H02K 7/116 74/425
2004/0174022 A1 * 9/2004 Inoue ..... E05B 81/06 292/216
2005/0167990 A1 * 8/2005 Orzech ..... E05B 81/14 292/201
2005/0253400 A1 11/2005 Harada et al.
2006/0012185 A1 * 1/2006 Kiehl ..... E05B 85/26 292/216
2007/0210588 A1 * 9/2007 Cetnar ..... E05B 77/28 292/216
2009/0145183 A1 * 6/2009 Maeta ..... E05C 3/24 70/237
2009/0160198 A1 * 6/2009 Yoda ..... E05B 81/06 292/201
2010/0072761 A1 * 3/2010 Tomaszewski ..... E05B 81/06 292/201
2010/0077806 A1 * 4/2010 Yamagata ..... E05B 83/36 70/91
2010/0127511 A1 * 5/2010 Vasquez ..... E05B 81/34 292/201
2010/0127512 A1 * 5/2010 Vazquez ..... E05B 85/26 292/216
2010/0223968 A1 9/2010 Krueger
2011/0204673 A1 * 8/2011 Cumbo ..... E05B 81/06 296/146.1
2011/0204690 A1 * 8/2011 Torkowski ..... E05B 85/26 297/354.12
2011/0304162 A1 * 12/2011 Dow ..... E05B 83/36 292/226
2012/0292927 A1 * 11/2012 Vazquez ..... B23P 11/00 292/200
2013/0056996 A1 * 3/2013 Akizuki ..... E05B 81/06 292/196
2013/0099510 A1 * 4/2013 Dow ..... E05B 81/15 292/226
2013/0099511 A1 * 4/2013 Dow ..... E05C 3/22 292/226
2014/0070549 A1 * 3/2014 Hanaki ..... E05B 81/06 292/200
2014/0175813 A1 * 6/2014 Margheritti ..... E05B 85/26 292/201
2014/0360235 A1 12/2014 Taurasi et al.
2015/0345189 A1 * 12/2015 Dow ..... E05B 81/34 292/200
2015/0368934 A1 * 12/2015 Tomaszewski ..... E05B 81/34 292/199
2016/0160537 A1 6/2016 Estrada et al.
2016/0362915 A1 * 12/2016 Perkins ..... E05B 81/16

* cited by examiner

SPRING RETAINING ASSEMBLY FOR VEHICLE LATCH ACTUATOR MECHANISM

CROSS REFERENCE TO RELATED APPLICATIONS

This application claims foreign priority under 35 U.S.C. § 119 to Chinese Patent Application No. 201720206424.2 filed on Mar. 3, 2017, the contents of which are incorporated herein by reference thereto.

BACKGROUND

The subject matter disclosed herein relates to vehicle latches and, more particularly, to a spring retaining assembly for an actuator mechanism for such vehicle latches.

Latches will typically require locking, and certain latches require certain security statuses. Central door locking (CDL) refers to a system of remotely locking the latch, typically by using an electric motor. A spring may be employed to assist in determining an angular position, and therefore a condition, of a gear arrangement by being coupled to a gear and to a fixed reference point. Unfortunately, the spring is often prone to unintended removal from the holes in which it is disposed. This can occur during assembly, thereby making the assembly process quite difficult.

SUMMARY

According to one embodiment, an actuator mechanism of a vehicle latch assembly includes an electric motor having an output shaft. Also included is a worm coupled to the output shaft. Further included is a worm gear driven by the worm. Yet further included is a spring operatively coupled to the worm gear and to a latch housing, the spring having a first leg extending through an aperture defined by the worm gear and a second leg extending into a receiving hole defined by the housing, the first leg including a first segment extending along a first leg axis and a second segment oriented at a non-parallel angle to the first leg axis, the second segment contacting a face of the worm gear to prevent removal of the spring.

According to another embodiment, a vehicle latch assembly includes a fork bolt. Also included is a pawl selectively engageable with the fork bolt to move the assembly between a first latch condition and a second latch condition. Further included is a housing for at least partially retaining the fork bolt and the pawl. Yet further included is an actuator mechanism for moving the pawl between the first latch condition and the second latch condition. The actuator mechanism includes an electric motor having an output shaft. The actuator mechanism also includes a worm coupled to the output shaft. The actuator mechanism further includes a worm gear driven by the worm. The actuator mechanism yet further includes a spring operatively coupled to the worm gear and to the housing, the spring having a first leg extending through an aperture defined by the worm gear and a second leg extending into a receiving hole defined by the housing, the first leg including a first segment extending along a leg axis and a second segment oriented at a non-parallel angle to the leg axis.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Referring now to the figures, which are exemplary embodiments, and wherein like elements are numbered alike.

The detailed description explains embodiments of the invention, together with advantages and features, by way of example with reference to the drawings.

DETAILED DESCRIPTION OF THE INVENTION

Figure 1:
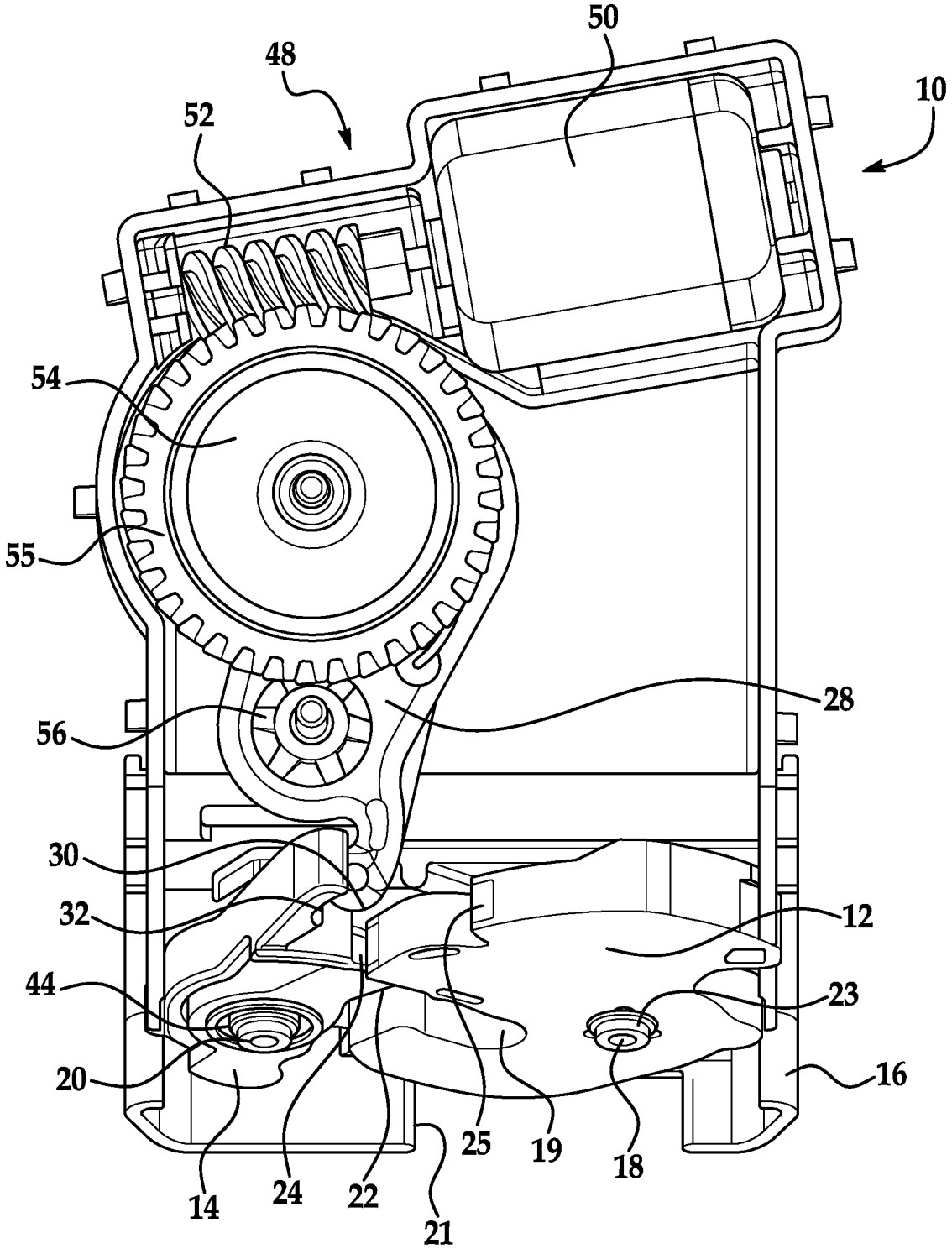
FIG. 1 is a perspective view of a latch assembly in a first position.

Referring now to FIG. 1, various embodiments of the invention will be described with reference to specific embodiments, without limitation. Illustrated are portions of a latch or latch assembly 10.

In one embodiment, the latch or latch assembly 10 may be a compartment latch. Latch 10 may be configured to keep a trunk lid latched, can keep a lift gate of a vehicle latched or a sliding door of vehicle closed, such as a van door. Still further the latch 10 can be used with any vehicle door or movable component that needs to be latched and unlatched with respect to the vehicle. In some embodiments, the latch or latch assembly 10 may include central door locking (CDL) which refers to a system of remotely locking the latch, typically by using an electric motor.

As described above, the latch 10 is applicable to any environment where the features of various embodiments of the invention are desired. For example, the latch assembly can be attached to a vehicle structure such that a fork bolt is moved between an open position and a closed position of the latch 10 when a hood, door, window, lift gate, etc. is opened and closed and the fork bolt engages a striker that is attached to the hood, door, window, lift gate, etc. Alternatively, the latch or latch assembly 10 can be secured to the hood, door, window, lift gate, etc. and the striker is secured to the vehicle body at an opening into which the hood, door, window, lift gate, etc. is received.

Latch 10 is located on a first element or first vehicle component which is either a frame (e.g., body member surrounding or proximate to an opening the movable member covers) or movable member (e.g., door, window, lift gate, hood, etc.) and includes a fork bolt or claw 12 and a detent lever or pawl 14, each of which may be pivotally or movably mounted to a housing 16 or another portion, or other housing portion of the latch 10. In some embodiments, the fork bolt 12 is capable of rotation about first stud or pin 18, while detent lever 14 is a capable of rotation about a second stud or pin 20. During operation, a striker is attached to a second element or second vehicle component, which is either the frame or movable member depending on which one has the latch 10 secured thereto.

In accordance with an exemplary embodiment, the fork bolt 12 is capable of movement between a first or latched position or closed position (FIG. 1) wherein the striker is engaged by a throat 19 of the fork bolt and a second or open position (FIG. 2) wherein the striker is free to be released from the throat 19 of the fork bolt 12. The housing 16 of the latch 10 will also have a complimentary opening 21 for receipt of the striker therein when it is engaged or latched by the fork bolt. In one non-limiting embodiment, the fork bolt 12 may be spring biased into the second or open position by a spring or biasing member 23.

Figure 2:
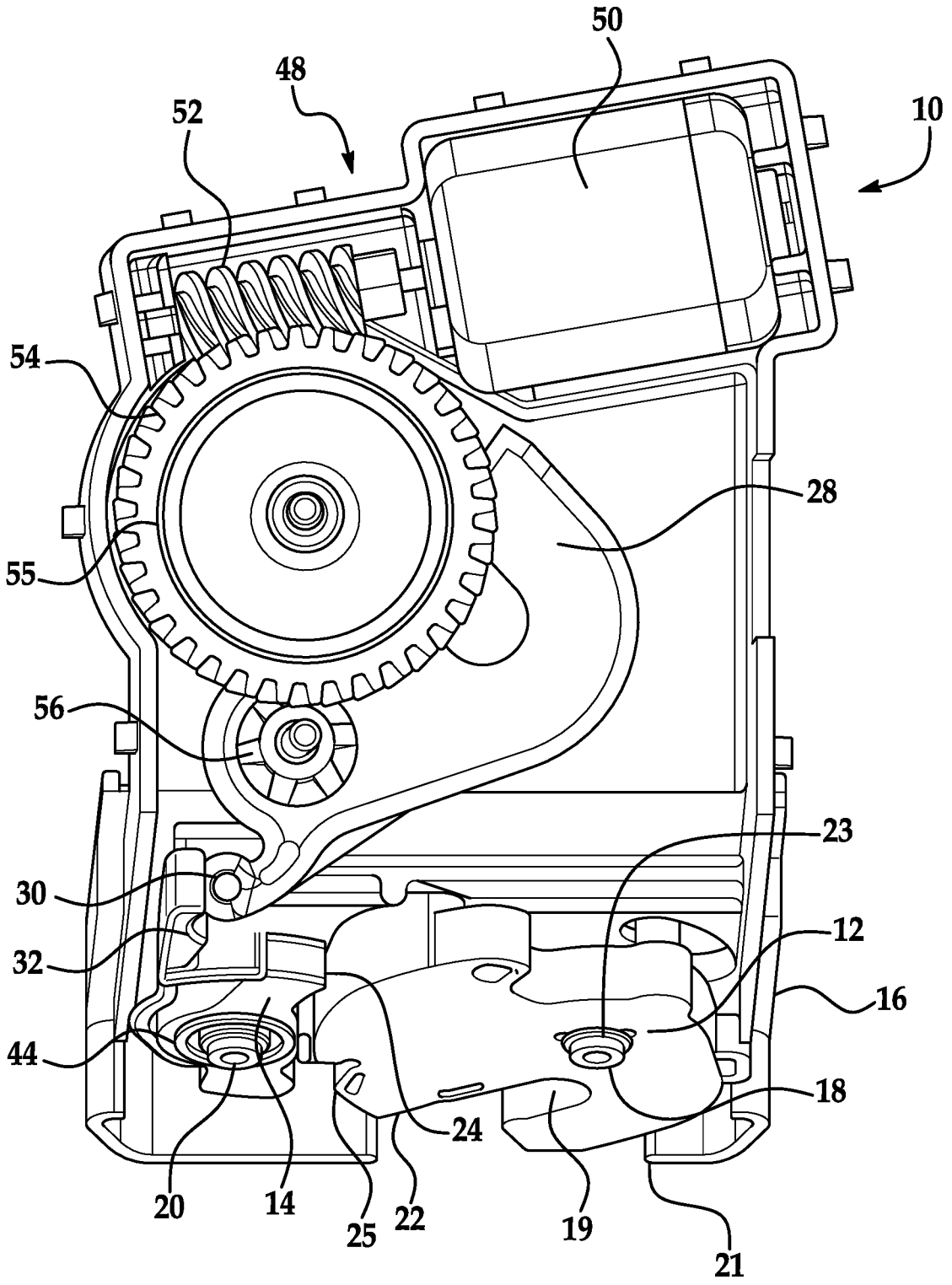
FIG. 2 is a perspective view of the latch assembly in a second position.

During operation and in order to retain the latch 10 or fork bolt 12 in the latched position, the detent lever or pawl 14 is pivotally secured to the latch 10 for movement between an engaged position or latched position (FIG. 1) and a disengaged position or released position (FIG. 2). When the detent lever 14 is in the engaged position, a surface 22 of the fork bolt 12 is engaged by a surface 24 of the detent lever 14 and the fork bolt 12 is prevented from moving toward the unlatched position from the latched position. In one configuration engagement of surface 22 by surface 24 of the detent lever 14 occurs when the fork bolt is in the primary or latched position and the detent lever 14 is in the engaged position. In order to provide a secondary latched position the fork bolt 12 may be configured to have a surface 25 that is engaged by surface 24 of the detent lever 14 when the fork bolt 12 is a secondary latched position (e.g. between the primary latched position and the open position) and when the detent lever is close enough to the engaged position such that surface 24 will be in a position to engage surface 25.

In addition, the latch 10 further comprises a lever or bell crank lever 28 also movably mounted to the latch 10 for movement between a first position (FIG. 1) and a second position (FIG. 2). As the lever or bell crank lever 28 moves from the first position to the second position, a contact portion 30 of the bell crank lever 28 makes contact with a contact portion 32 of the detent lever 14 and moves the detent lever 14 from the engaged position or latched position to the disengaged position or released position. In one non-limiting exemplary embodiment, contact portion 30 of the bell crank lever or lever 28 is not directly or physically secured to contact portion 32 of the detent lever 14 such that the bell crank lever or lever 28 can push the detent lever 14 however bell crank lever or lever 28 cannot pull the detent lever 14. Similarly, detent lever 14 can push the bell crank lever or lever 28 but cannot pull the bell crank lever or lever 28. As illustrated and in some embodiments, contact portion 30 of the bell crank lever or lever 28 may be configured to have curved surface that is received within a complimentary curved receiving surface 32 of the detent lever 14 when contact portion 30 of the bell crank lever or lever 28 contacts portion 32 of the detent lever 14. Alternatively, the bell crank lever or lever 28 may be fixedly (e.g. pivotally or otherwise) secured to the detent lever 14.

In order to provide the desired movement of the detent lever 14 from the engaged position to the disengaged position, and actuator or actuator system 48 is provided. In one embodiment the actuator or actuator system 48 comprises a motor 50 configured to drive a worm 52 for rotating a worm gear 54 rotatably mounted to the latch or latch assembly 10. Worm gear 54 is also operatively coupled to the bell crank lever or lever 28 also pivotally mounted to the latch or latch assembly 10. In one embodiment, rotation worm gear 54 will cause movement of the bell crank lever or lever 28 from its first position to its second position via a plurality of gears 56 located on bell crank lever or lever 28. Gears 56 are configured to mesh with a plurality of gears 55 of the worm gear 54. As mentioned above, movement of the bell crank lever or lever 28 from the first position to the second position will cause the detent lever 14 to move from its engaged position to its disengaged position.

When the actuator 48 is activated worm 52 is driven by a motor 50 such that worm gear 54 is rotated and bell crank lever or lever 28 is rotated until bell crank lever or lever 28 is in the second position.

Figure 3:
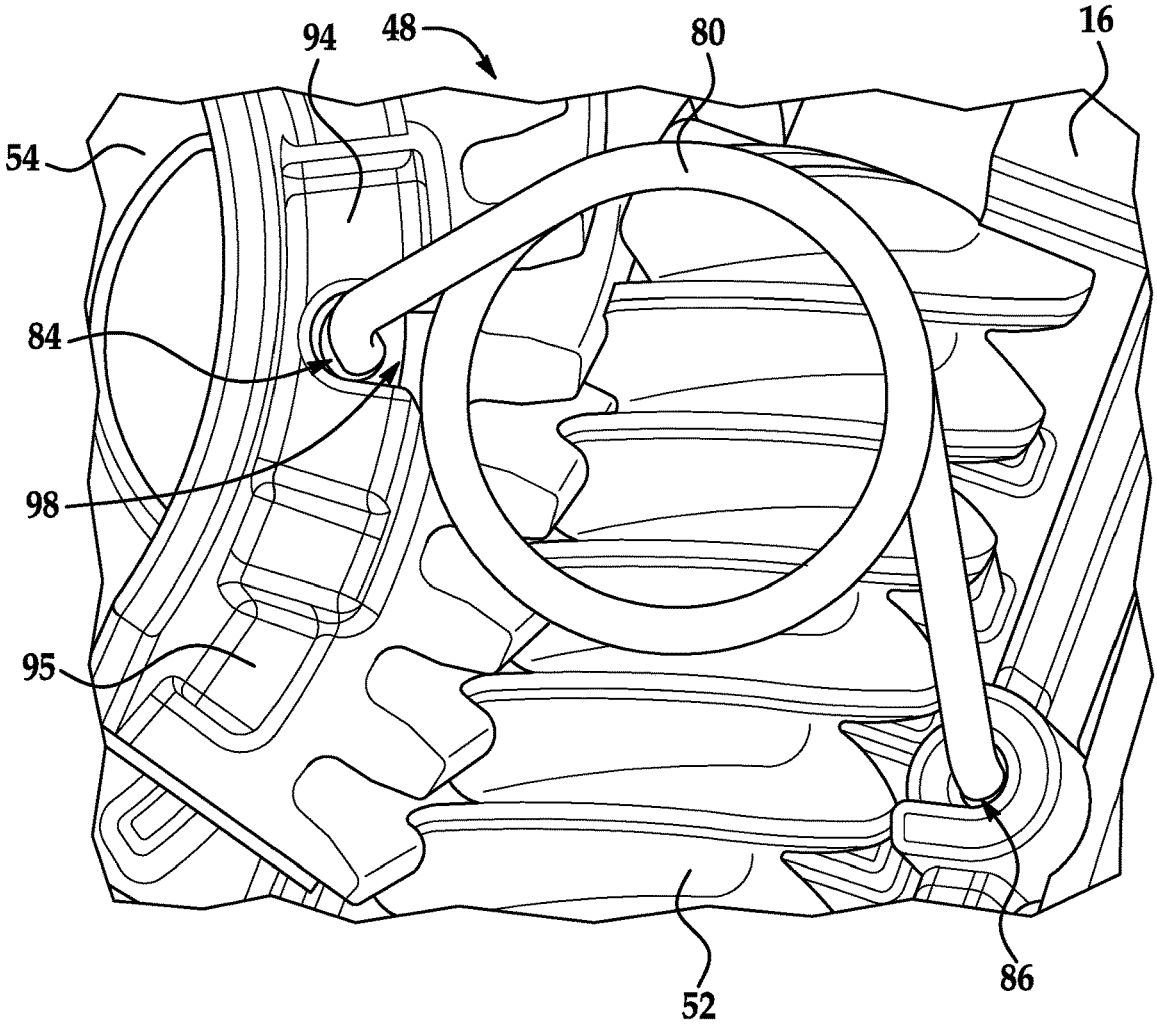
FIG. 3 is a perspective view of a portion of an actuator mechanism of the latch assembly.
Figure 4:
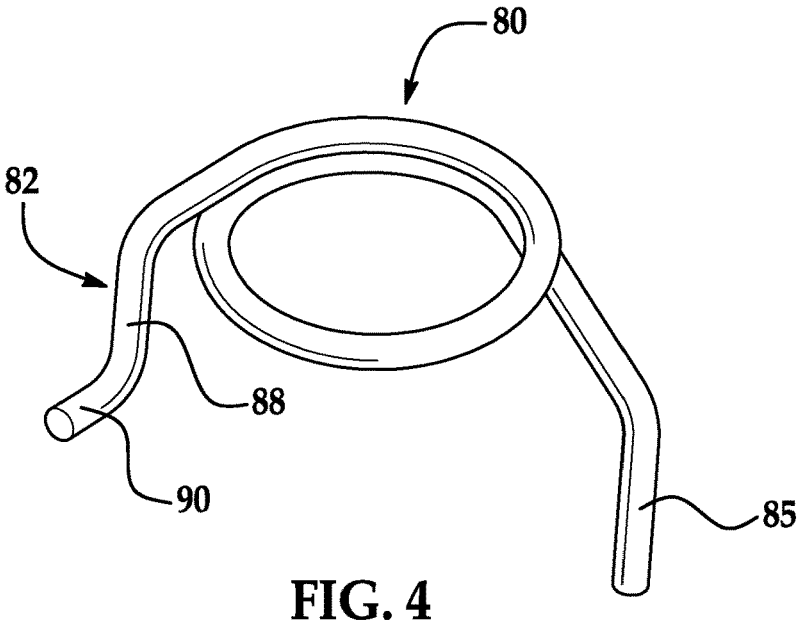
FIG. 4 is a perspective view of a spring of the actuator mechanism.

Referring to FIG. 3, a spring 80 is fixed to the worm gear 54 and to a fixed point. In the illustrated embodiment, the fixed point that the spring 80 is fixed to is the housing 16. The spring 80 may be any suitable spring, such as a torsion spring, for example. Torque is transferred to spring 80 from the motor 50 via the worm gear 54, as the spring is in direct contact with the worm gear 54 and when the worm gear 54 rotates, the spring 80 is deflected. Deflection of the spring 80 may be monitored to provide feedback to a door ECU to inform of the current state of the latch 10.

Referring now to FIGS. 3-9, the spring 80 is coupled to the worm gear 54 and the fixed point (e.g., housing 16) by inserting legs of the spring 80 into respective apertures or holes of the worm gear 80 and fixed point, as described herein. The spring 80 includes a first leg 82 that is insertable into an aperture 84 defined by the worm gear 54. A second leg 85 of the spring 80 is insertable into a receiving hole 86 defined by the housing 16. The first leg 82 has at least two segments that are angularly oriented relative to each other. In particular, the first leg 82 includes a first portion 88 and a second portion 90. The first portion 88 extends along a first leg axis and the second portion 90 is oriented at a non-parallel angle from the first leg axis. In some embodiments, the non-parallel angle is substantially perpendicular to the first leg axis. In other embodiments, the non-parallel angle is between 90 degrees and 180 degrees. In other embodiments, the non-parallel angle is between 0 degrees and 90 degrees. By angling the first and second portions 88, 90 from each other, the second portion 90 acts as a retaining portion of the first leg 82 when fully inserted through the aperture 84 of the worm gear 54.

Figure 6:
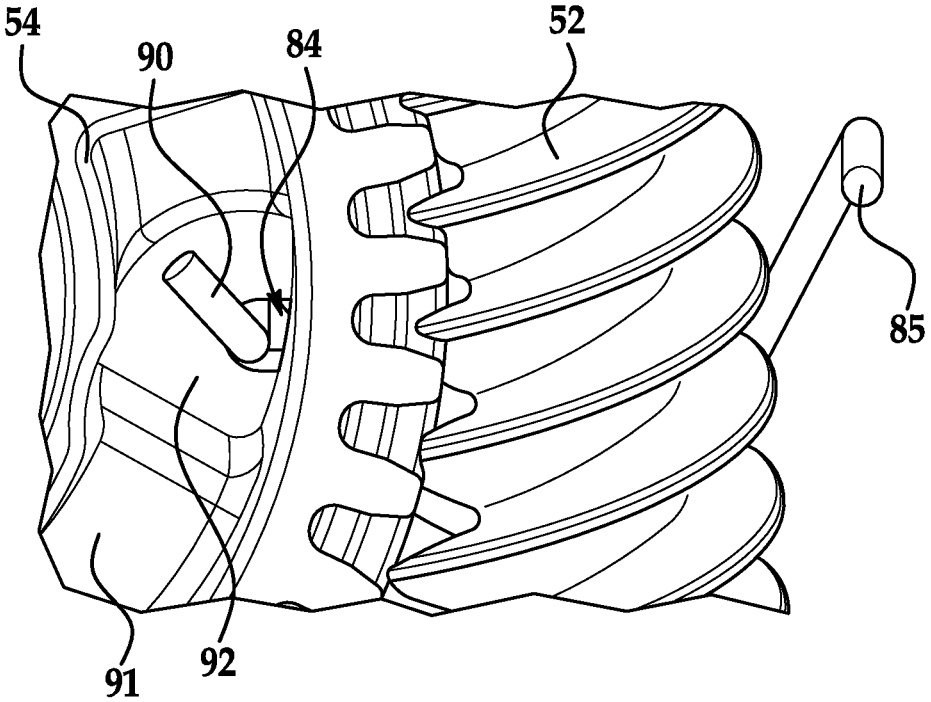
FIG. 6 is a perspective view of the second leg coupled to the worm gear according to another aspect of the disclosure.

FIG. 6 shows a block segment 91 of a first face 92 of the worm gear 54 that the second portion 90 of the first leg 82 is in close proximity to or in contact with. The block segment 91 is a thicker segment of the worm gear 54 that is a surface that the second portion 90 interacts with. In a fully assembled position, the second portion 90 may be in abutment with the face 92 or may be slightly spaced therefrom. Irrespective of whether a space is present, if a force acting on the spring 80 biases the first leg 82, the second portion 90 contacts the block segment 91 to prevent withdrawal of the first leg 82 from the aperture 84, thereby retaining the spring 80 in the assembled position.

Figure 5:
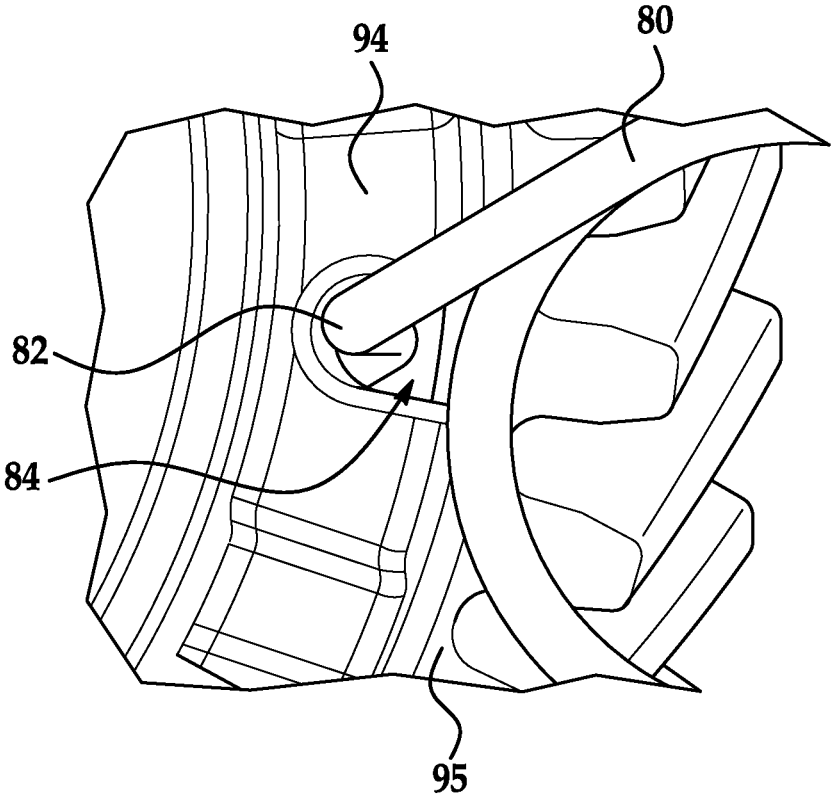
FIG. 5 is a perspective view of a first leg of the spring coupled to a worm gear of the actuator mechanism.
Figure 7:
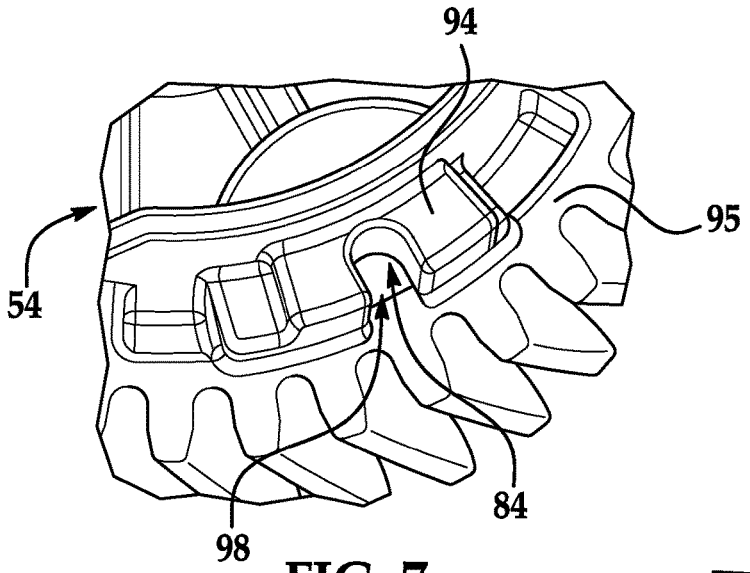
FIG. 7 is a perspective view of an aperture of the worm gear.

As shown in FIGS. 3, 5 and 7, the aperture 84 is partially defined by a block 94 on a face 95 of the worm gear 54 that opposes face 92. The block 94 includes a block cutout portion 98 that eases assembly by providing an opened insertion location for the first leg 82 that includes the second portion 90.

Figure 8:
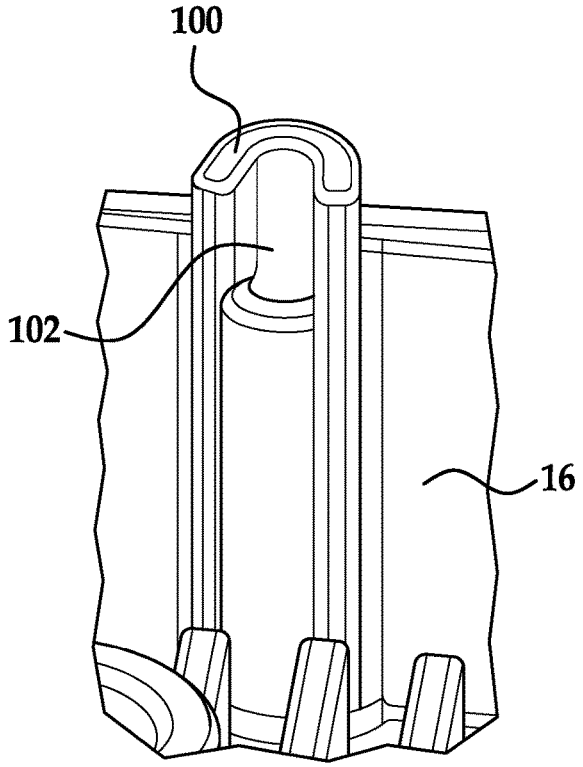
FIG. 8 is a perspective view of a receiving hole of a fixed structure for receiving a second leg of the spring.
Figure 9:
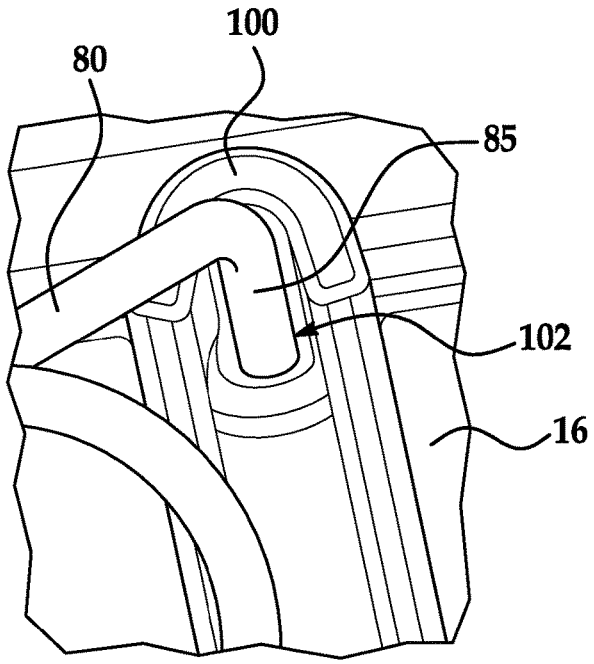
FIG. 9 is a perspective view of the second leg inserted in the receiving hole.

Referring now to FIGS. 8 and 9, the receiving hole 86 is defined by a wall 100 of the housing 16. The wall 100 includes a wall cutout portion 102 that eases assembly by providing an opened insertion location for the second leg 85 of the spring 80. In some embodiments, the second leg 85 is substantially parallel to the first leg axis. Further, the second leg 85 may be parallel to the first leg 82 along an entirety of the second leg 85 in some embodiments.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity)

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An actuator mechanism of a vehicle latch assembly comprising:

an electric motor having an output shaft;

a worm coupled to the output shaft;

a worm gear driven by the worm; and a spring operatively coupled to the worm gear and to a latch housing, the spring having a first leg extending through an aperture defined by the worm gear and a second leg extending into a receiving hole defined by the housing, the first leg including a first segment extending along a first leg axis and through the aperture and a second segment extending from the first segment to a distal end of the first leg, the second segment oriented at a non-parallel angle to the first leg axis, the second segment contacting a face of the worm gear to prevent removal of the spring.

2. The actuator mechanism of claim 1, wherein the second segment of the first leg is oriented perpendicularly to the first segment of the first leg.

3. The actuator mechanism of claim 1, wherein the second segment of the first leg is oriented at an angle between 90 degrees and 180 degrees relative to the first segment of the first leg.

4. The actuator mechanism of claim 1, wherein the second segment of the first leg is oriented at an angle less than 90 degrees relative to the first segment of the first leg.

5. The actuator mechanism of claim 1, wherein the aperture of the worm gear is at least partially defined by a block portion having a block cutout portion.

6. The actuator mechanism of claim 1, wherein the receiving hole is defined by a wall cutout portion of a wall.

7. The actuator mechanism of claim 1, wherein the second leg extends along a second leg axis that is parallel to the first leg axis.

8. The actuator mechanism of claim 7, wherein the second leg extend along the second leg axis for an entirety of the second leg.

9. The actuator mechanism of claim 1, wherein the vehicle latch assembly is a central door locking latch assembly and the actuator mechanism is part of the central door locking latch assembly.

10. A vehicle latch assembly comprising:

a fork bolt;

a pawl selectively engageable with the fork bolt to move the assembly between a first latch condition and a second latch condition;

a housing for at least partially retaining the fork bolt and the pawl; and an actuator mechanism for moving the pawl between the first latch condition and the second latch condition, the actuator mechanism comprising:

an electric motor;

a worm operably coupled to the electric motor;

a worm gear driven by the worm; and a spring operatively coupled to the worm gear and to the housing, the spring having a first leg extending through an aperture defined by the worm gear and a second leg extending into a receiving hole defined by the housing, the first leg including a first segment extending along a leg axis and through the aperture and a second segment extending from the first segment to a distal end of the first leg, the second segment oriented at a non-parallel angle to the leg axis.

11. The vehicle latch assembly of claim 10, wherein the second segment of the first leg is oriented perpendicularly to the first segment of the first leg.

12. The vehicle latch assembly of claim 10, wherein the second segment of the first leg is oriented at an angle between 90 degrees and 180 degrees relative to the first segment of the first leg.

13. The vehicle latch assembly of claim 10, wherein the second segment of the first leg is oriented at an angle less than 90 degrees relative to the first segment of the first leg.

14. The vehicle latch assembly of claim 10, wherein the aperture of the worm gear is at least partially defined by a block portion having a block cutout portion.

15. The vehicle latch assembly of claim 10, wherein the receiving hole is defined by a wall cutout portion of a wall.

16. The vehicle latch assembly of claom 10, wherein the second leg extends along a second leg axis that is parallel to the leg axis.

17. The vehicle latch assembly of claim 16, wherein the second leg extends along the second leg axis for an entirety of the second leg.

18. The vehicle latch assembly of claim 10, wherein the vehicle latch assembly is a central door locking latch assembly and the actuator mechanism is part of the central door locking latch assembly.

19. The actuator mechanism of claim 1, wherein the first leg and the second leg are located on opposite sides of the worm.

20. The vehicle latch assembly of claim 10, wherein the first leg and the second leg are located on opposite sides of the worm.

* * * * *